US007491095B1

(12) United States Patent
Huang

(10) Patent No.: US 7,491,095 B1
(45) Date of Patent: Feb. 17, 2009

(54) POWER SUPPLY SOCKET DEVICE

(75) Inventor: Cheng-Po Huang, Taipei County (TW)

(73) Assignee: Enermax Technology Corporation, Taoyuan (TW)

( * ) Notice: Subject to any disclaimer, the term of this patent is extended or adjusted under 35 U.S.C. 154(b) by 0 days.

(21) Appl. No.: 12/071,626

(22) Filed: Feb. 25, 2008

(51) Int. Cl.
*H01R 13/10* (2006.01)

(52) U.S. Cl. ..... 439/682; 439/358; 439/78

(58) Field of Classification Search ..... 439/682, 439/78, 350, 357, 358
See application file for complete search history.

(56) References Cited

U.S. PATENT DOCUMENTS 4,674,819 A * 6/1987 Fujitani et al. ..... 439/404
4,767,342 A * 8/1988 Sato ..... 439/78
4,797,123 A * 1/1989 Weber ..... 439/717
4,820,169 A * 4/1989 Weber et al. ..... 439/65
5,137,462 A * 8/1992 Casey et al. ..... 439/74
5,352,125 A * 10/1994 Banakis et al. ..... 439/83
5,588,849 A * 12/1996 Kile ..... 439/83
5,855,064 A * 1/1999 Chang ..... 29/861
6,129,598 A * 10/2000 Yu et al. ..... 439/883
6,935,902 B1 * 8/2005 Chou ..... 439/701
7,086,871 B2 * 8/2006 Park ..... 439/78
7,094,109 B2 * 8/2006 Chou ..... 439/651
7,114,982 B2 * 10/2006 Shimizu et al. ..... 439/358
7,121,879 B1 * 10/2006 Chou et al. ..... 439/564
7,133,293 B2 * 11/2006 Fiorentino et al. ..... 361/752
7,187,544 B2 * 3/2007 Tsai ..... 361/686
7,238,046 B2 * 7/2007 Chou et al. ..... 439/541.5
7,252,525 B2 * 8/2007 Ide et al. ..... 439/248
7,270,578 B2 * 9/2007 Hunag ..... 439/638
7,279,634 B1 * 10/2007 Chang ..... 174/50.5
7,313,000 B2 * 12/2007 Fiorentino et al. ..... 361/752
7,364,459 B2 * 4/2008 Tsai ..... 439/554
7,425,154 B2 * 9/2008 Fiorentino ..... 439/590
7,442,076 B2 * 10/2008 Huang ..... 439/502
7,448,915 B2 * 11/2008 Chou ..... 439/638
2003/0139082 A1 * 7/2003 Aramoto et al. ..... 439/358
2004/0092155 A1 * 5/2004 Lo et al. ..... 439/476.1
2005/0085108 A1 * 4/2005 Park ..... 439/78
2005/0186855 A1 * 8/2005 Shimizu et al. ..... 439/682
2005/0202726 A1 * 9/2005 Chou ..... 439/639
2005/0208837 A1 * 9/2005 Chou ..... 439/651
2005/0237724 A1 * 10/2005 Fiorentino et al. ..... 361/752
2005/0266711 A1 * 12/2005 Petersen et al. ..... 439/225
2005/0287857 A1 * 12/2005 Hsu ..... 439/225
2006/0205282 A1 * 9/2006 Chou ..... 439/651
2007/0099451 A1 * 5/2007 Chou et al. ..... 439/79

(Continued)

*Primary Examiner*—Ross N Gushi
(74) *Attorney, Agent, or Firm*—Bacon & Thomas, PLLC

(57) ABSTRACT

A power supply socket device includes a circuit board and sockets. Each socket is a rectangular base, and the sockets are arranged linearly on the circuit board and have insert holes in the sockets. The insert holes are arranged in rows and columns with at least one row, and each row includes linearly arranged insert holes, and the number of insert holes in any row of each socket is greater than the number of insert holes of any column of each socket, such that the socket has a short socket side and a long socket side, and a latch lump is protruded from an appropriate position of the short socket side. The invention provides a quick, simple and convenient way of connecting a power supply and achieves the effects of simplifying the circuit board and improving the economic benefit of the manufacture and assembling and the competitiveness of the product.

4 Claims, 6 Drawing Sheets

U.S. PATENT DOCUMENTS

2007/0128945 A1* 6/2007 Huang ..... 439/638
2007/0141883 A1* 6/2007 Bulcea ..... 439/215
2007/0224846 A1* 9/2007 Fiorentino ..... 439/66
2007/0254524 A1* 11/2007 Chang ..... 439/505
2007/0270003 A1* 11/2007 Lin et al. ..... 439/101
2007/0270017 A1* 11/2007 Hardacker et al. ..... 439/357
2007/0270028 A1* 11/2007 Huang ..... 439/502
2008/0076277 A1* 3/2008 Chen et al. ..... 439/78
2008/0139022 A1* 6/2008 Chen et al. ..... 439/101
2008/0166900 A1* 7/2008 Chang ..... 439/76.1
2008/0274631 A1* 11/2008 Lee et al. ..... 439/78

* cited by examiner

POWER SUPPLY SOCKET DEVICE

BACKGROUND OF THE INVENTION

1. Field of the Invention

The present invention relates to a power supply device, and more particularly to a power supply socket device that provides a quick, simple and convenient way of connecting/removing a power supply to/from a power socket and achieves the effects of simplifying the circuit board and improving the economic benefit of the manufacture and assembling and the competitiveness of the product.

2. Description of the Related Art

In general, a computer usually comes with a power supply for converting an external 110V or 220V DC power into a +3.3V, +5V, +12V DC power and supplying the required power to hardware equipments including a motherboard, a hard disk and an optical disk drive, and thus the power supply has a plurality of DC output power sockets provided for connecting various different hardware equipments for the power supply. In a traditional power supply socket structure as shown in FIG. 1, the structure includes a circuit board 90 and a plurality of power sockets 91, and the circuit board 90 includes a plurality of power supply contacts 901 and a power supply circuit 902, and the power socket 91 is a rectangular base, having a plurality of insert holes 911 and a pin 912 corresponding to each insert hole 911, and the pin 912 is electrically coupled to the power supply contact 901, and a push-and-plug latch lump 913 is disposed at the top and the bottom of the power socket 91, such that the power supply plug 92 of the hardware equipment has a hook-shaped latch 921 snapped into the latch lump 913 for connecting with each others securely.

In FIG. 1, although the aforementioned traditional power supply socket can be used for supplying power to various different hardware equipments, the structure still has the following drawbacks. The traditional power supply socket has a plurality of insert holes 911 arranged in a form of a 2×3 matrix (which includes two rows and three columns), such that the power socket 91 forms a rectangular base with a short base side 91A and a long base side 91B, and the latch lump 913 is installed on the long base side 91B, and then the power sockets 91 are installed in two rows, such that when an operator holds the power supply plug 92 by a finger to connect the power supply as shown in FIG. 1, another power supply plug 92 at the top or the bottom may interfere the action, and thus it is difficult to successfully or quickly push the power supply plug 92 into the power socket 91. If the operator's finger is large, then the connection to the power supply will be more inconvenient. Since a computer needs to connect several power supply plugs 92 with several power sockets 91, the inconvenient instillation operation will seriously affect the economic benefit of the computer production and assembly lines. Further, the power supply contact 901 of the pin 912 is connected to the power supply contact 901 of each power socket 91, and there are three power supply contacts 901 on a row, so that the layout of the power supply circuit 902 of the circuit board 90 becomes very complicated or even requires a multi-layer board for the design, and thus incurring a higher cost of the circuit board 90. The prior art not only fails to meet the economic benefit requirement, but also lowers the competitiveness of the product. Obviously, the prior art is not good enough. Therefore, it is an important subject for manufacturers to overcome the shortcomings of the traditional power supply socket.

In view of the shortcomings of the prior art, the inventor of the present invention based on years of experience in the related industry to conduct extensive researches and experiments, and finally developed a power supply socket device in accordance with the present invention to overcome the shortcomings of the prior art.

SUMMARY OF THE INVENTION

Therefore, it is a primary objective of the present invention to overcome the shortcomings of the prior art by providing a power supply socket device that provides a quick, simple and convenient way of connecting a power supply and achieves the effects of simplifying the circuit board and improving the economic benefit of the manufacture and assembling and the competitiveness of the product.

To achieve the foregoing objective, the present invention provides a power supply socket device comprising a circuit board and a plurality of sockets. Each socket is substantially a rectangular base, and the sockets are arranged linearly on the circuit board, and have a plurality of insert holes arranged in a matrix with at least one row, and each row includes a plurality of linearly arranged insert holes, and the number of insert holes in any row of each socket is greater than the number of insert holes in any column of each socket, so that the socket forms a short socket side and a long socket side, and each long socket side of the plurality of sockets is an adjacent connecting side, and a latch lump is protruded from an appropriate position of the short socket side.

To make it easy for our examiner to understand the above and other objects, features and advantages of the present invention, we use preferred embodiments accompanied with the related drawings for the following detailed description of the invention.

DETAILED DESCRIPTION OF THE PREFERRED EMBODIMENTS

Figure 6:
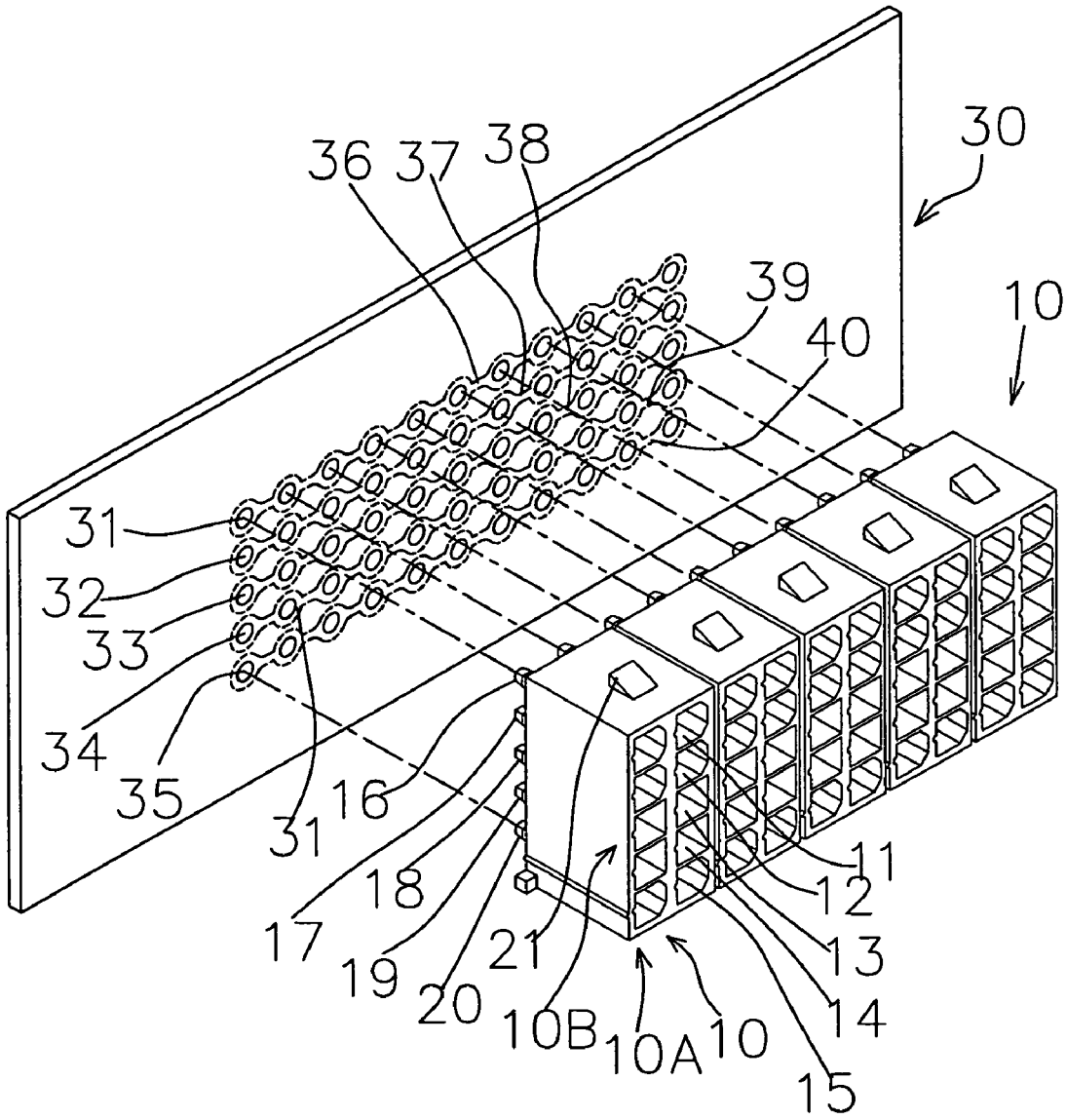
FIG. 6 is an exploded view of a socket and a circuit board in accordance with another preferred embodiment of the present invention.

The power supply socket device of the invention comprises a plurality of sockets 10, each having a plurality of insert holes 11~15 arranged in a matrix with at least one row (wherein the matrix includes one or more rows and one or more columns), and each row has a plurality of linearly arranged insert holes, and the number of insert holes in any row of each socket is greater than the number of insert holes in any column. The insert holes are arranged in a single row as shown in FIG. 2 or in two rows as shown in FIG. 6.

Figure 1:
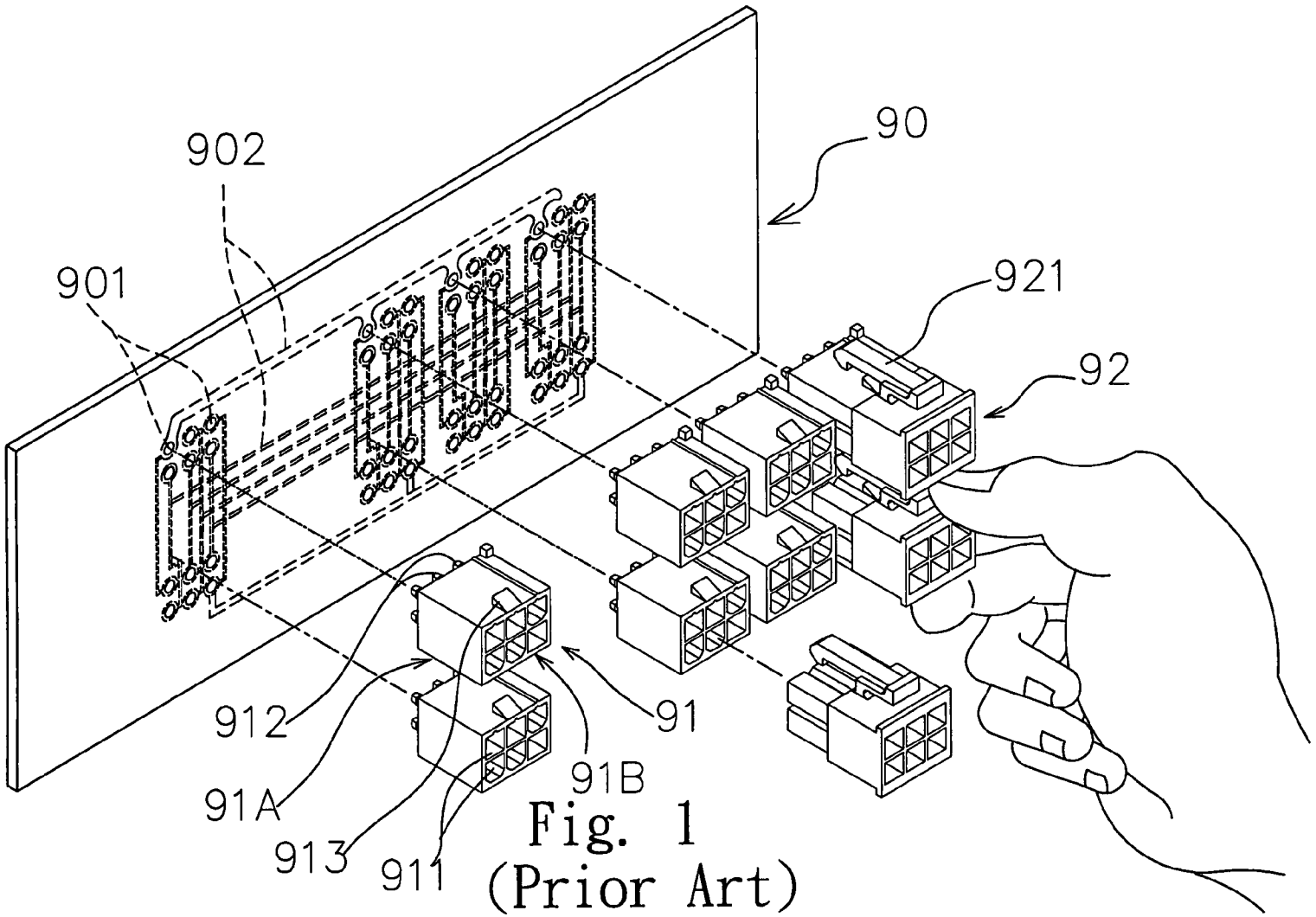
Fig. 1 (Prior Art)
FIG. 1 is a schematic view of a power supply socket of a prior art.
Figure 2:
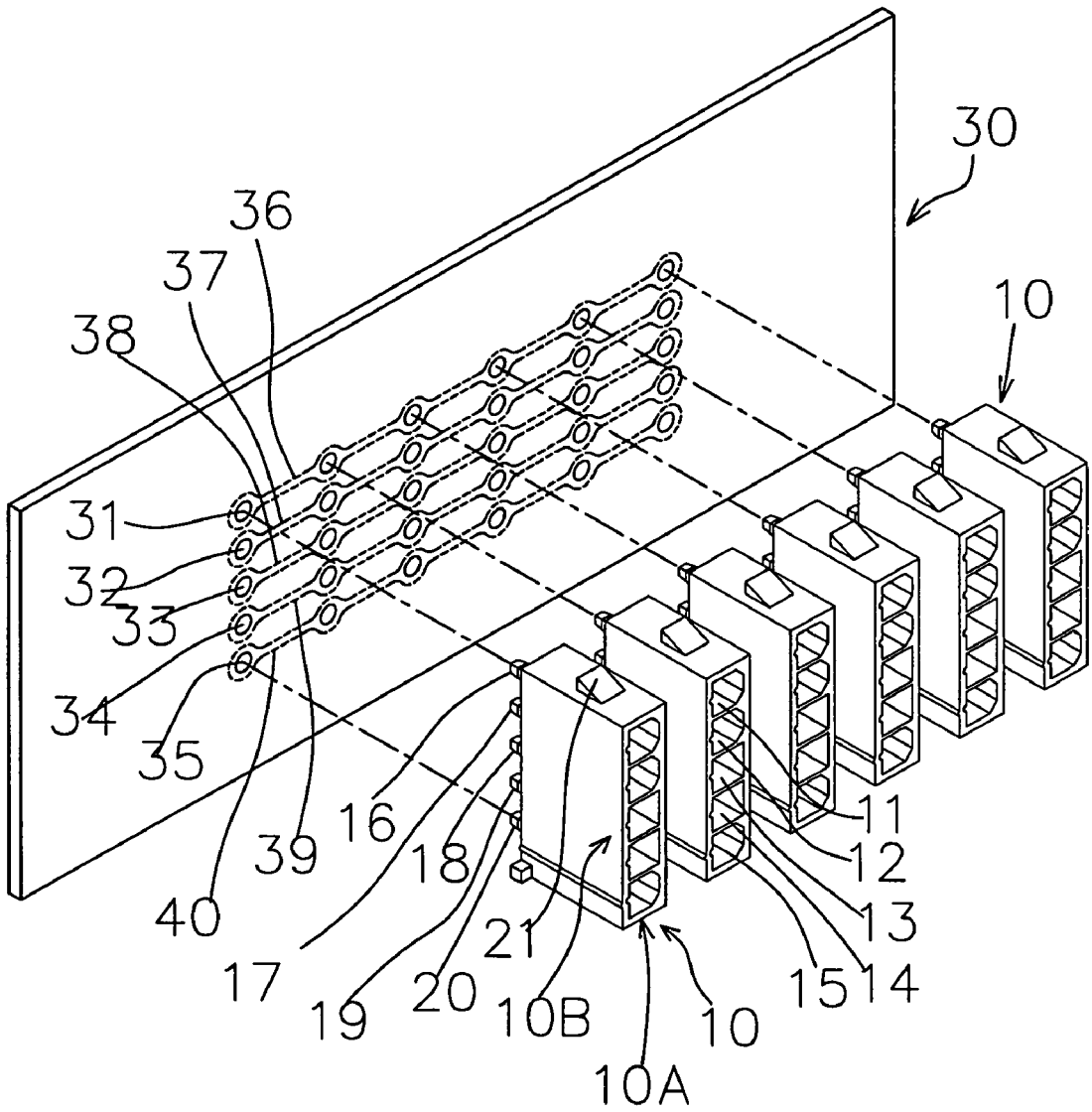
FIG. 2 is an exploded view of a socket and a circuit board.
Figure 3:
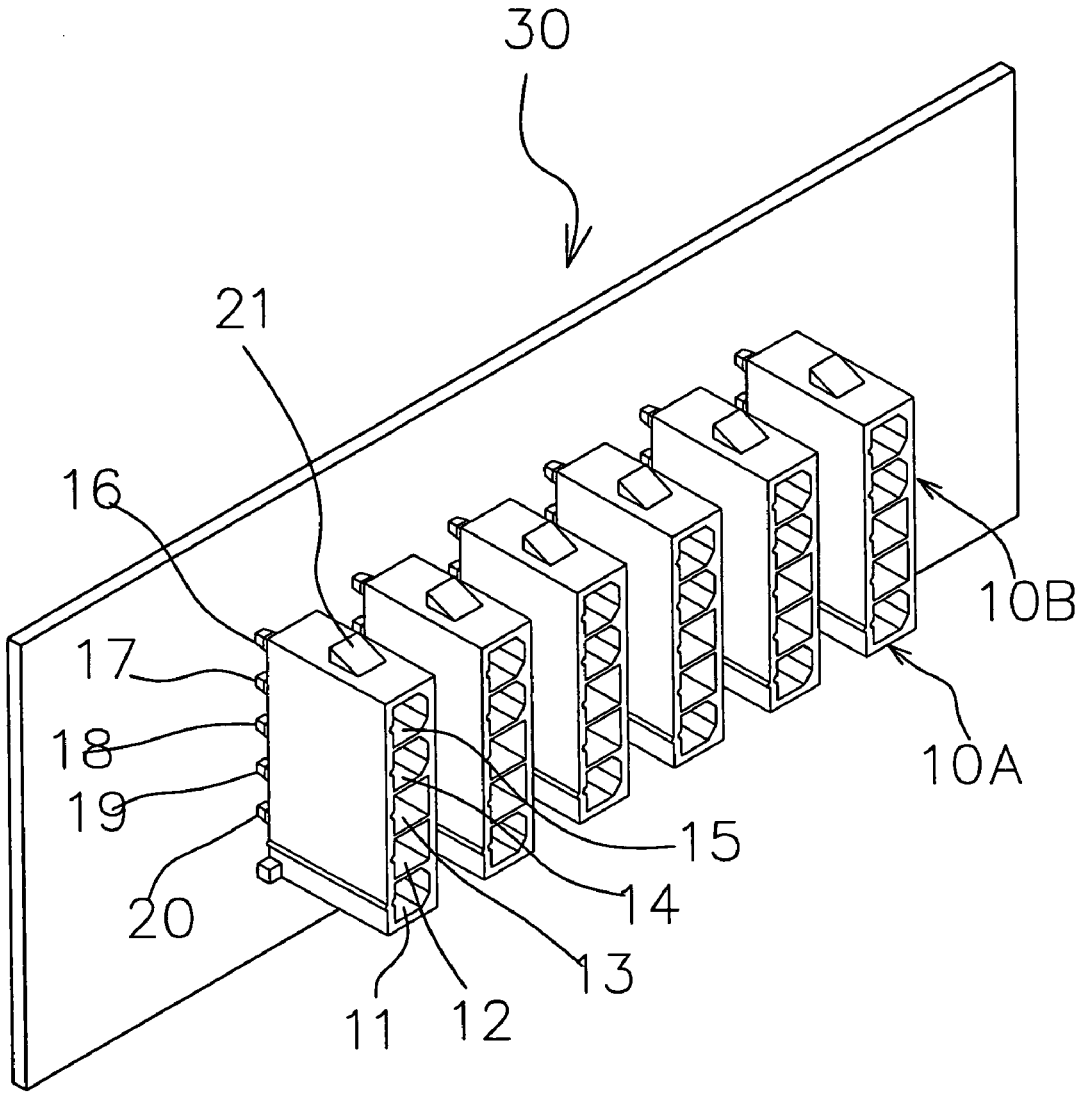
FIG. 3 is a schematic view of assembling a socket to a circuit board in accordance with the present invention.

In an embodiment as shown in FIGS. 2 and 3, an 1×5 matrix of insert holes 11, 12, 13, 14, 15 are arranged linearly on the socket 10, and the socket 10 forms two corresponding sides respectively a short socket side 10A and a long socket side 10B, and a rear end of the socket 10 includes a pin 16, 17, 18, 19, 20 corresponding to the insert hole 11~15, and the socket 10 has a push-and plug latch lump 21 disposed at an appropriate position of the top and the bottom of the short socket side 10A.

The invention further comprises a circuit board 30 having a plurality of power supply contacts 31, 32, 33, 34, 35 corresponding to the pins 16~20 respectively, and the power supply contacts 31~35 are connected to the power supply contacts 31~35 arranged longitudinally on the same column by the power supply circuits 36, 37, 38, 39, 40 arranged transversally on the same row. When the power supply socket device is assembled, the plurality of sockets 10 are fixed onto the circuit board 30, and the pins 16~20 of the socket 10 are connected to the power supply contacts 3135 of the circuit board 30 respectively, such that the plurality of sockets 10 can supply electric power to different hardware equipments (such as a motherboard, a hard disk and an optical disk drive, etc.)

Figure 4:
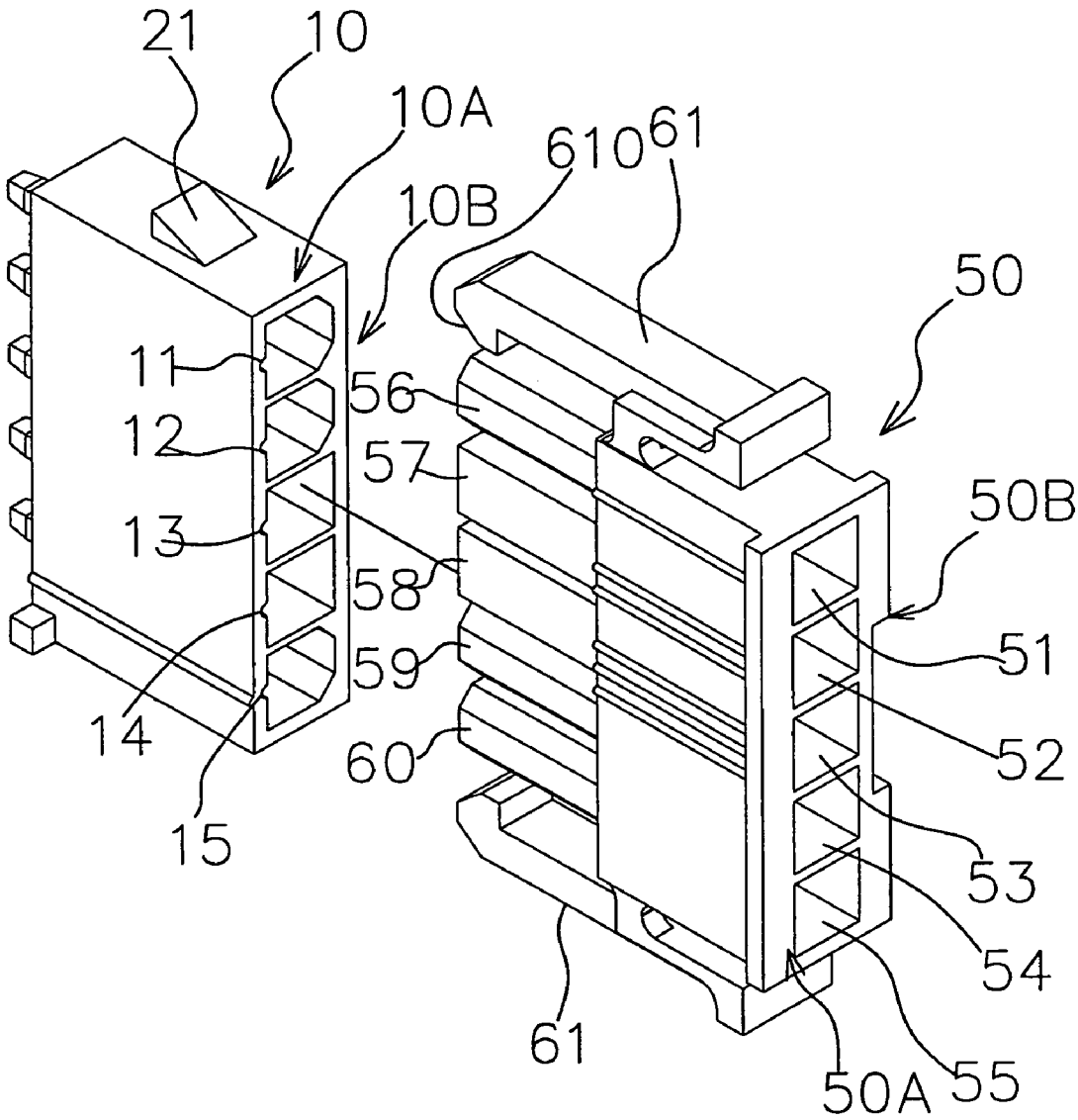
FIG. 4 is an exploded view of a socket and a plug in accordance with the present invention.
Figure 5:
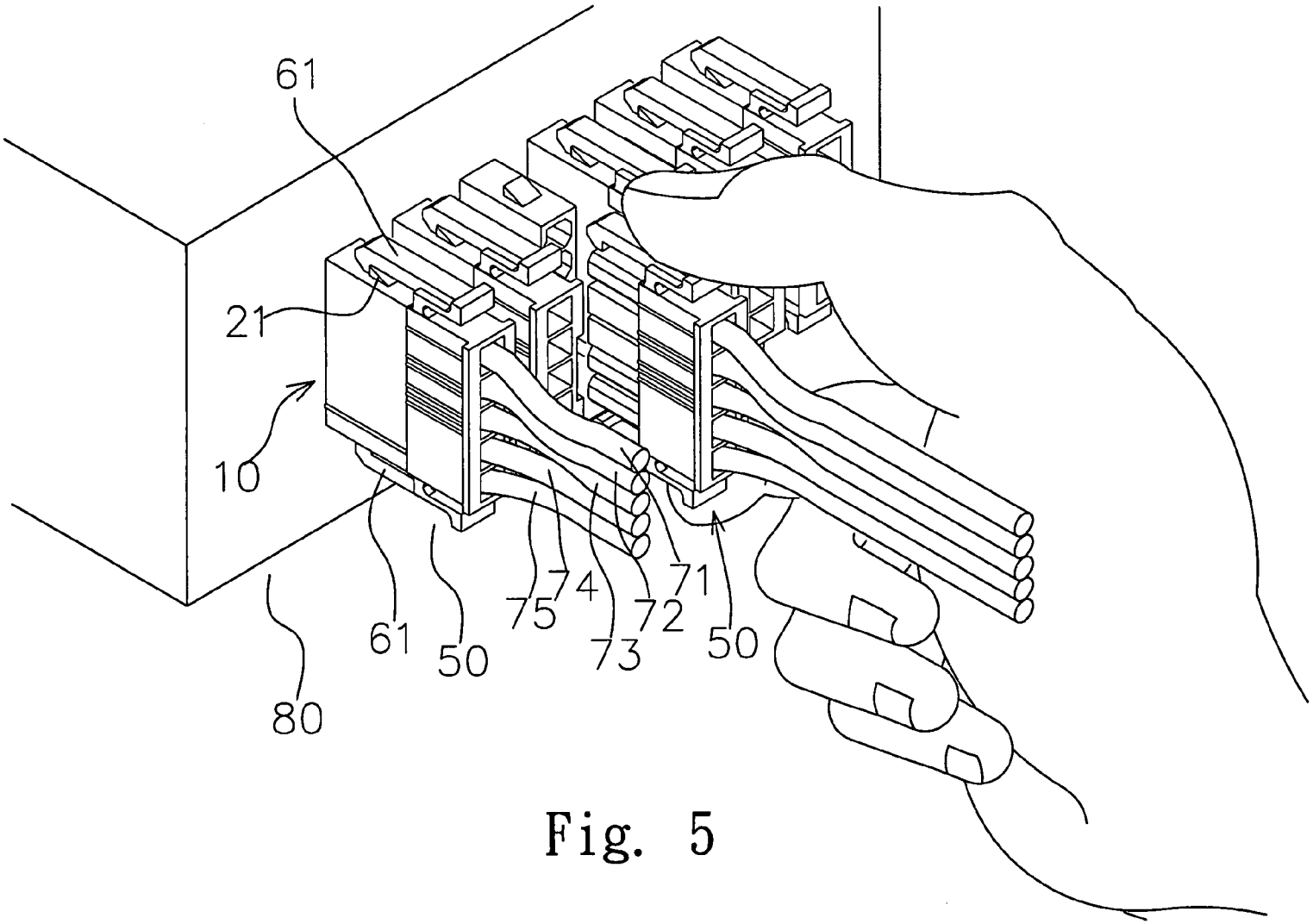
FIG. 5 is a schematic view of connecting a socket and a plug accordance with the present invention.

In FIGS. 4 and 5, a plug 50 used by different hardware equipments for connecting a power supply socket device is installed into the corresponding socket 10 of the base, and the plug 50 includes a plurality of connecting holes 51, 52, 53, 54, 55 arranged linearly in a column as shown in the figures, and the plug 50 forms two corresponding sides respectively a short plug side 50A and a long plug side 50B, and a rear end of the plug 50 has a plurality of inserts 56, 57, 58, 59, 60 corresponding to the wire connecting holes 51~55 respectively, wherein the wire connecting holes 51~55 are inserted with the conducting wires 71, 72, 73, 74, 75, and the conducting wires 71~75 are electrically coupled to the inserts 56~60. Further, the plug 50 has an elastic hook-shaped latch 61 disposed at an appropriate position of the short plug side 50A, and a free end of the latch 61 has an aslant push-and-pull surface 610 for facilitating the connection of the latch lump 21 of the socket 10.

In FIGS. 2 and 5, the plurality of sockets 10 are arranged linearly when the power supply device 80 of the invention is assembled, and connected adjacent to the long socket side 10B of each socket 10, such that the latch lump 21 of the short socket side 10A will not be interfered by the arrangement of the sockets 10. When the plug 50 and the socket 10 are connected, an operator simply uses fingers to hold the plug 50 and push plug 50 the socket 10 horizontally and quickly, without the risk of being interfered by the plugs 50 nearby, and finally snap the latch 61 to the latch lump 21. The invention provides a simple and easy connection of a power supply, and gives a good effect to the computer assembling and production lines.

In the meantime, the insert holes 11~15 of a single socket 10 are arranged linearly, and the plurality of sockets 10 are arranged linearly perpendicular to the direction of the linearly arranged insert holes, so that each power supply contact 31~35 on the circuit board 30 can be connected easily. The invention makes the layout of the power supply circuit 36~40 simple and easily, and just requires a single-layer circuit board, which achieves the effect of lowering the production cost of the circuit board 30, simplifying the inspection and maintenance processes, and meeting the economic benefit requirement of the manufacture.

In summation of the above description, the present invention herein enhances the performance than the conventional structure and further complies with the patent application requirements and is duly filed for patent application. While the invention is described in some detail hereinbelow with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

What is claimed is:

1. A power supply socket device, comprising:

a circuit board;

a plurality of sockets, each being substantially a rectangular base, and having a short socket side and a long socket side, and said plurality of sockets being arranged linearly on said circuit board, and said each long socket side being an adjacent connecting side, and an appropriate position of said short socket side having a protruding latch lump;

a plurality of insert holes, being disposed separately on said each socket, and said plurality of insert holes being arranged in a matrix form on said sockets, and having at least one row, and the number of insert holes of any row of said each socket being greater than the number of insert holes of any column of said each socket.

2. The power supply socket device according to claim 1, wherein said socket comprises a plurality of pins disposed at a rear end of said socket and corresponding to said insert holes respectively.

3. The power supply socket device according to claim 2, wherein said circuit board comprises a plurality of power supply contacts corresponding to said pins correspondingly, and said power supply contacts are coupled with said linearly arranged power supply contacts by a power supply circuit.

4. The power supply socket device according to claim 2, wherein said socket is provided for connecting a plug, and said plug comprises a short plug side and a long plug side, and said short plug side includes an elastic hook-shaped latch corresponding to said latch lump.

* * * * *